US006062226A

United States Patent [19]

Kida

[11] Patent Number: 6,062,226

[45] **Date of Patent: *May 16, 2000**

[54] CIGARETTE MANUFACTURING APPARATUS

[75] Inventor: Shinzo Kida, Tokyo, Japan

[73] Assignee: Japan Tobacco Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/011,658

[22] PCT Filed: Jun. 13, 1997

[86] PCT No.: PCT/JP97/02048

§ 371 Date: Feb. 13, 1998

§ 102(e) Date: Feb. 13, 1998

[87] PCT Pub. No.: WO97/47211

PCT Pub. Date: Dec. 18, 1997

[30] Foreign Application Priority Data

Jun. 13, 1996 [JP] Japan ..... 8-152571

[51] Int. Cl.[7] ..... A24C 5/18

[52] U.S. Cl. ..... 131/84.1; 131/280; 131/906; 131/907; 131/908; 131/910

[58] Field of Search ..... 131/84.1, 280, 131/906, 908, 910, 907

[56] References Cited

U.S. PATENT DOCUMENTS

| | | | |
|---|---|---|---|
| 4,269,201 | 5/1981 | Powell et al. | 131/280 |
| 4,280,187 | 7/1981 | Reuland et al. | 131/280 |
| 4,785,830 | 11/1988 | Moller et al. | 131/84.1 |
| 4,986,285 | 1/1991 | Radzio et al. | 131/906 |
| 5,526,827 | 6/1996 | Kubo et al. . | |
| 5,531,234 | 7/1996 | Inomata et al. | 131/906 |
| 5,568,818 | 10/1996 | Neri et al. | 131/906 |
| 5,746,225 | 5/1998 | Okumoto et al. | 131/84.1 |
| 5,762,075 | 6/1998 | Hoppe et al. | 131/84.1 |

FOREIGN PATENT DOCUMENTS

| | | | |
|---|---|---|---|
| 160799 | 11/1985 | European Pat. Off. | 131/280 |
| 160800 | 11/1985 | European Pat. Off. | 131/280 |
| 268124 | 5/1988 | European Pat. Off. | 131/280 |
| 7518208 | 1/1976 | France | 131/908 |
| 3242204 | 5/1984 | Germany | 131/208 |
| 2428567 | 1/1997 | Germany | 131/280 |
| 6-277030 | 10/1994 | Japan . | |
| 7-308179 | 11/1995 | Japan . | |
| 7-308180 | 11/1995 | Japan . | |
| 1048663 | 11/1966 | United Kingdom | 131/280 |
| 2033724 | 5/1980 | United Kingdom | 131/280 |
| 2033725 | 5/1980 | United Kingdom | 131/280 |
| 2060870 | 5/1981 | United Kingdom | 131/908 |

OTHER PUBLICATIONS

Translation of JP 7–308179, Jul. 1998.

*Primary Examiner*—Stanley S. Silverman
*Assistant Examiner*—Michael P. Colaianni
*Attorney, Agent, or Firm*—Birch, Stewart, Kolasch & Birch, LLP

[57] ABSTRACT

When tobacco shreds continuously supplied while the supply amount thereof is controlled are wrapped continuously with an elongated cigarette paper to form a tobacco rod and the tobacco rod is cut to predetermined lengths to manufacture cigarettes, the filling amount (filling density) of tobacco shreds at every portion in the lengthwise direction of tobacco rod is continuously measured in connection with the wrapping operation of the tobacco rod. The filling amount (momentary value) at every portion of the tobacco rod is compared with threshold values set in advance to detect a local excess filling portion and/or deficient filling portion of the tobacco shreds. This detection result is output in synchronization with the conveying timing of a cigarette having a predetermined length continuously cut from the tobacco rod, by which a cigarette including the local excess filling portion or deficient filling portion of tobacco shreds can be rejected surely.

5 Claims, 5 Drawing Sheets

*Prior Art*

*Prior Art*

CIGARETTE MANUFACTURING APPARATUS

This application claims the benefit under 35 U.S.C. §371 of prior PCT International Application No. PCT/JP97/02048 which has an International filing date of Jun. 13, 1997 which designated the United States of America, the entire contents of which are hereby incorporated by references.

TECHNICAL FIELD

The present invention relates to a cigarette manufacturing apparatus for manufacturing cigarettes by continuously supplying tobacco shreds obtained by finely cutting tobacco leaves, continuously wrapping the continuously supplied tobacco shreds with an elongated cigarette paper to form a tobacco rod, and then cutting the tobacco rod to predetermined lengths. More particularly, the present invention relates to a cigarette manufacturing apparatus having a function of detecting local excess and deficiency of the filling amount of tobacco shreds in a tobacco rod to reject a cigarette which is cut from the tobacco rod if it has a local excess filling portion or deficient filling portion of tobacco shreds.

BACKGROUND ART

FIG. 1 shows a schematic configuration of a cigarette manufacturing apparatus. This cigarette manufacturing apparatus continuously supplies tobacco shreds 2*a* fed into a hopper 1 to a wrapping unit 4 by sucking them to the lower surface of a conveyor belt (tobacco band) provided in a suction unit 3. The suction amount (supply amount) of tobacco shreds 2*a* sucked to the lower surface of the conveyor belt 3*a* is controlled by a trimming disk 5. The wrapping unit 4 continuously wraps the tobacco shreds with an elongated cigarette paper 6 supplied continuously from a roll R to form a long tobacco rod 2*b*. This tobacco rod 2*b* is cut to predetermined lengths in a cutting section 7. For example, the tobacco rod 2*b* is cut into cigarette rods 2*c* of a double unit length, which corresponds to a length of substantially two final cigarettes, and the cigarette rods 2*c* are supplied to a filter attachment unit 8.

The wrapping unit 4 is provided with a garniture tape 4*b* drivingly run by a main shaft 4*a*. As shown in FIG. 2, the garniture tape 4*b* rolls both sides of the cigarette paper 6 inside and upward while conveying the cigarette paper 6 supplied from the roll R, and continuously wraps the tobacco shreds 2*a* supplied onto the cigarette paper 6 in cooperation with a tongue 4*c* disposed opposingly above the garniture tape 4*b*. By this wrapping operation, the long tobacco rod 2*b*, in which the tobacco shreds 2*a* are wrapped with the cigarette paper 6, is continuously formed. The running speed of the conveyor belt 3*a*, which determines the supply speed of tobacco shreds 2*a* to the wrapping unit 4, is determined in synchronization with the rotation of the main shaft 4*a*, that is, depending on the running speed of the garniture tape 4*b*.

The trimming disk 5 is rotated in synchronization with the rotation of the main shaft 4*a* (running speed of the garniture tape 4*b*). The trimming disk 5 regulates the thickness of tobacco shreds 2 sucked to the lower surface of the conveyor belt 3*a*, and controls the suction amount (supply amount) of tobacco shreds 2*a* conveyed to the wrapping unit 4 by scraping away the excess shreds. By the control of the supply amount of tobacco shreds 2*a* using the trimming disk 5, the amount of tobacco shreds 2*a* wrapped with the cigarette paper 6, that is, the amount (filling amount) of tobacco shreds 2*a* in the tobacco rod 2*b* is controlled.

The trimming disk 5 is provided with pockets 5*a* for partially increasing the filling amount of tobacco shreds 2*a* in the tobacco rod 2*b*. The presence of these pockets partially increases the suction amount (supply amount) of tobacco shreds 2*a* conveyed to the wrapping unit 4, for example, each time the disk makes a half turn. As a result, the filling amount (filling density) of tobacco shreds 2*a* in the tobacco rod 2*b* is increased partially at every predetermined portion in the lengthwise direction. The hardened portion where the filling density of tobacco shreds 2*a* is increased is the cut portion where the aforesaid cigarette rods 2*c* are cut off, and further each cigarette is cut off. As a result, the tobacco shreds 2 are prevented from dropping off the cigarette dense end.

The filling density of tobacco shreds 2*a* in the tobacco rod 2*b* is detected continuously by using, for example, a radiation density detector. By integrating the filling density of tobacco shreds 2*a*, which is continuously detected at every portion in the lengthwise direction of tobacco rod 2*b* in sequence, over a predetermined length in the lengthwise direction of tobacco rod 2*b*, for example, the total filling amount and average filling amount, and further the standard deviation of filling amount, and the like per one cigarette are determined.

In accordance with this detection result, the supply amount of tobacco shreds 2*a* is variably controlled, for example, by the trimming disk 5, so that the filling amount (filling density) of tobacco shreds 2*a* in the tobacco rod 2*b* is controlled. If it is judged from the aforementioned detection result that the total filling amount or average filling amount of tobacco shreds 2*a* per one cigarette is short, the cigarette rod 2*c* or cigarette cut from the tobacco rod 2*b*, which includes the portion where the filling amount is short, is rejected.

The tobacco shreds 2*a* sometimes drop off the cigarette dense end due to the deficiency of filling amount (filling density) of tobacco shreds 2*a*. Therefore, the state of the cigarette dense end is checked by using, for example, a photosensor or capacitance proximity sensor. If the dropping-off of tobacco shreds 2*a* is found, that cigarette (cigarette rod 2*c*) is also rejected.

As described above, even if the whole filling amount of tobacco shreds 2*a* in the tobacco rod 2*b* is controlled, some variations in filling density are naturally caused. In particular, as the cigarette manufacturing speed, specifically the wrapping speed of tobacco rod 2*b*, increases, the variations in the filling density in the lengthwise direction of tobacco rod 2*b* increases. For example, due to the slip of the cigarette paper 6 with respect to the garniture tape 4*b*, or the reaction of the tobacco shreds 2*a* when the tobacco shreds 2*a* are sucked to the conveyor belt (tobacco band), the filling density of tobacco shreds 2*a* in the tobacco rod 2*b* is increased (hard spot) or decreased (soft spot) locally.

The excess filling portion (hard spot) of tobacco shreds 2*a* hinders the air flow in the cigarette, exerting an influence upon the cigarette quality. Meanwhile, the deficient filling portion (soft spot) of tobacco shreds 2*a* causes variations in the burning state, for example, during smoking. Further, the deficient filling portion (soft spot) of tobacco shreds 2*a* hinders uniform smoking, and has an influence upon the change in burning velocity, the yielding amount of tar and nicotine, and in turn the smoking taste.

Conventionally, however, the filling state of tobacco shreds 2*a* in the tobacco rod 2*b* is monitored merely, for example, as the average filling amount etc. per one cigarette, as described above. Also, the dropping-off state of tobacco shreds 2*a* at the cut end of a cigarette is merely monitored.

The present invention was made in view of the above situation, and accordingly an object thereof is to detect a local excess filling portion (hard spot) and deficient filling portion (soft spot) of tobacco shreds in a tobacco rod efficiently and reliably, and to surely reject a cigarette rod or cigarette cut from the tobacco rod, which includes the local excess filling portion (hard spot) or deficient filling portion (soft spot) of tobacco shreds.

Another object of the present invention is to improve the production quality of a cigarette by reliably rejecting a cigarette including the local excess filling portion (hard spot) or deficient filling portion (soft spot) of tobacco shreds in consideration of the fact that these defective portions are liable to be produced as the cigarette manufacturing speed increases.

The present invention provides a cigarette manufacturing apparatus capable of achieving these objects.

DISCLOSURE OF THE INVENTION

To achieve the above objects, the present invention provides a cigarette manufacturing apparatus for continuously manufacturing cigarettes by continuously wrapping tobacco shreds, which are continuously supplied while the supply amount thereof is controlled, with an elongated cigarette paper to form a tobacco rod and cutting the tobacco rod to predetermined lengths, the cigarette manufacturing apparatus comprising:

measuring means for continuously measuring the filling amount of tobacco shreds at every portion in the lengthwise direction of the tobacco rod in connection with the continuous wrapping operation of the tobacco rod;

detecting means for detecting a local excess filling portion and/or deficient filling portion of the tobacco shreds at every portion in the lengthwise direction of the tobacco rod by comparing the filling amount (momentary value) at every portion in the lengthwise direction of the tobacco rod determined by the measuring means with a threshold value set in advance; and means for outputting the detection result in synchronization with the conveying timing of cigarette containing the local excess filling portion or deficient filling portion of the tobacco shreds among the cigarettes of a predetermined length cut sequentially from the tobacco rod.

That is to say, the filling amount of tobacco shreds at every portion in the lengthwise direction of the tobacco rod is detected by the measuring means, and the momentary value of the filling amount detected by the measuring means is compared with predetermined threshold values, by which local excess and deficiency of the filling amount of tobacco shreds at every portion in the lengthwise direction of the tobacco rod are judged. The judgment result is output in synchronization with the conveying timing (cut timing) of cigarettes cut from the tobacco rod including the detected portion, by which a cigarette including a local excess filling portion (hard spot) or deficient filling portion (soft spot) of tobacco shreds can be rejected surely.

Also, according to the invention defined in claim 2, the total filling amount of tobacco shreds per one cigarette cut from the tobacco rod is determined by integrating the filling amount detected by the measuring means. The supply amount of tobacco shreds supplied for the wrapping operation is controlled in accordance with the total filling amount of tobacco shreds, and a cigarette in which the filling amount of tobacco shreds is short is detected by judging the total filling amount of tobacco shreds.

Also, according to the invention defined in claim 3, when the control of the supply amount of the tobacco shreds is carried out so that the filling amount of tobacco shreds at the cut portion of tobacco rod continuously wrapped with the cigarette paper is larger than the filling amount of tobacco shreds at portions other than the cut portion, a first threshold value set to be higher than the target filling density of tobacco shreds at the cut portion and a second threshold value set to be lower than the target filling density of tobacco shreds at portions other than the cut portion are used. When the filling density of tobacco shreds at every portion in the lengthwise direction of the tobacco rod is higher than the first threshold value, the tobacco rod portion where that filling density is detected is judged to be an excess filling portion, and when the filling density is lower than the second threshold value, the tobacco rod portion where that filling density is detected is judged to be a deficient filling portion.

That is to say, the filling amount of tobacco shreds in the tobacco rod is controlled so that the filling amount is partially increased at the cut portion. Apart from the change in the filling amount (filling density) at every portion in the lengthwise direction, the first threshold value for judging the local excess filling of tobacco shreds is set to be larger than the target filling density of tobacco shreds at the cut portion of the tobacco rod, and the second threshold value for judging the local deficient filling of tobacco shreds is set to be lower than the target filling density of the tobacco shreds at portions other than the cut portion. Thereupon, the local excess filling portion (hard spot) and/or deficient filling portion (soft spot) of tobacco shreds, which pose a production quality problem, can be detected easily and surely.

Further, according to the invention defined in claim 4, the detection result of the excess filling portion or deficient filling portion is output in synchronization with the conveying timing of cigarettes cut from the tobacco rod, by which instructions to reject a cigarette including a defective portion are given surely.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BEST MODE OF CARRYING OUT THE INVENTION

To explain the present invention in more detail, one embodiment of a cigarette manufacturing apparatus in accordance with the present invention will be described with reference to the accompanying drawings.

Figure 1:
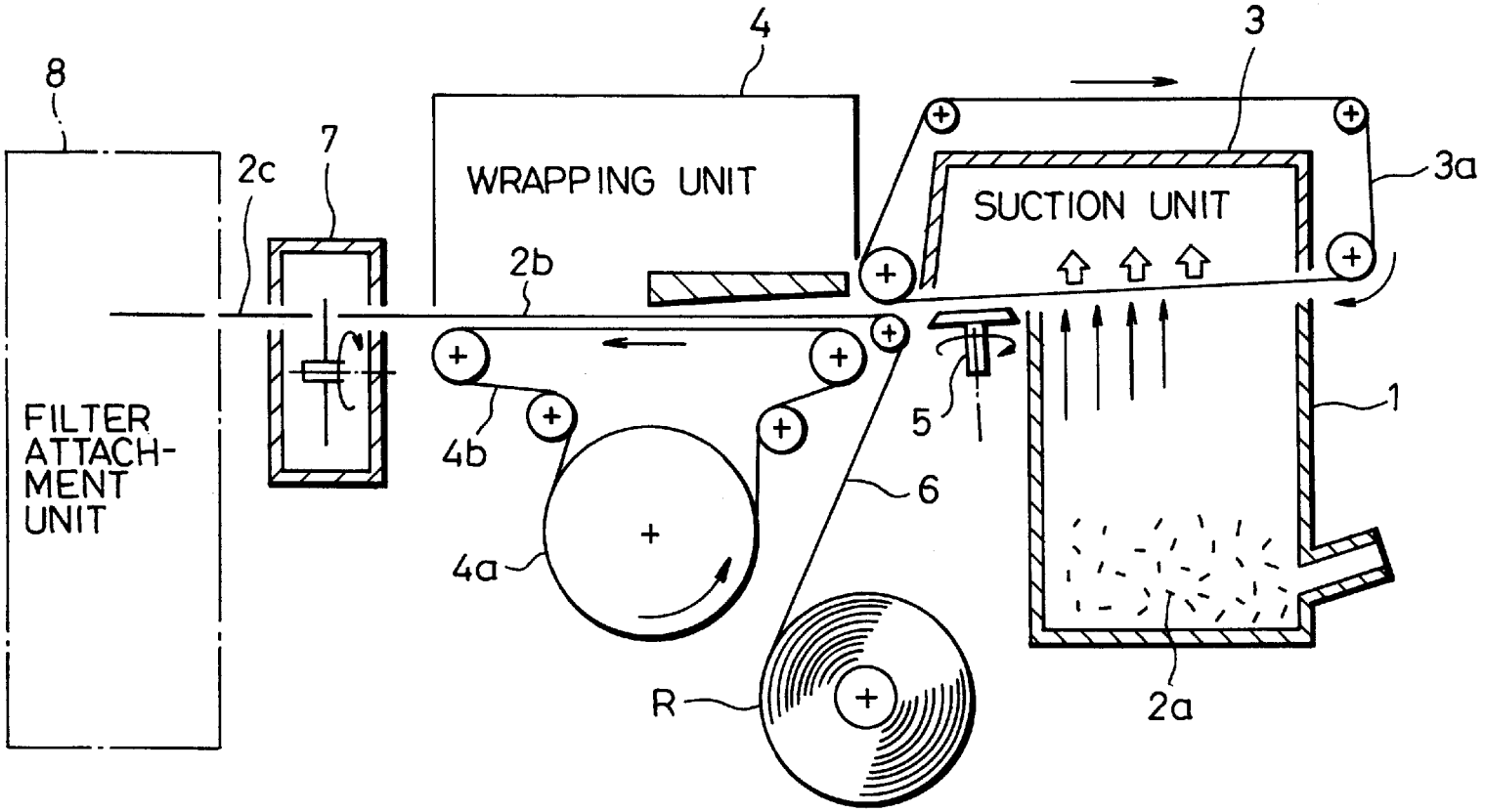
FIG. 1 is a general schematic view of a cigarette manufacturing apparatus.
Figure 2:
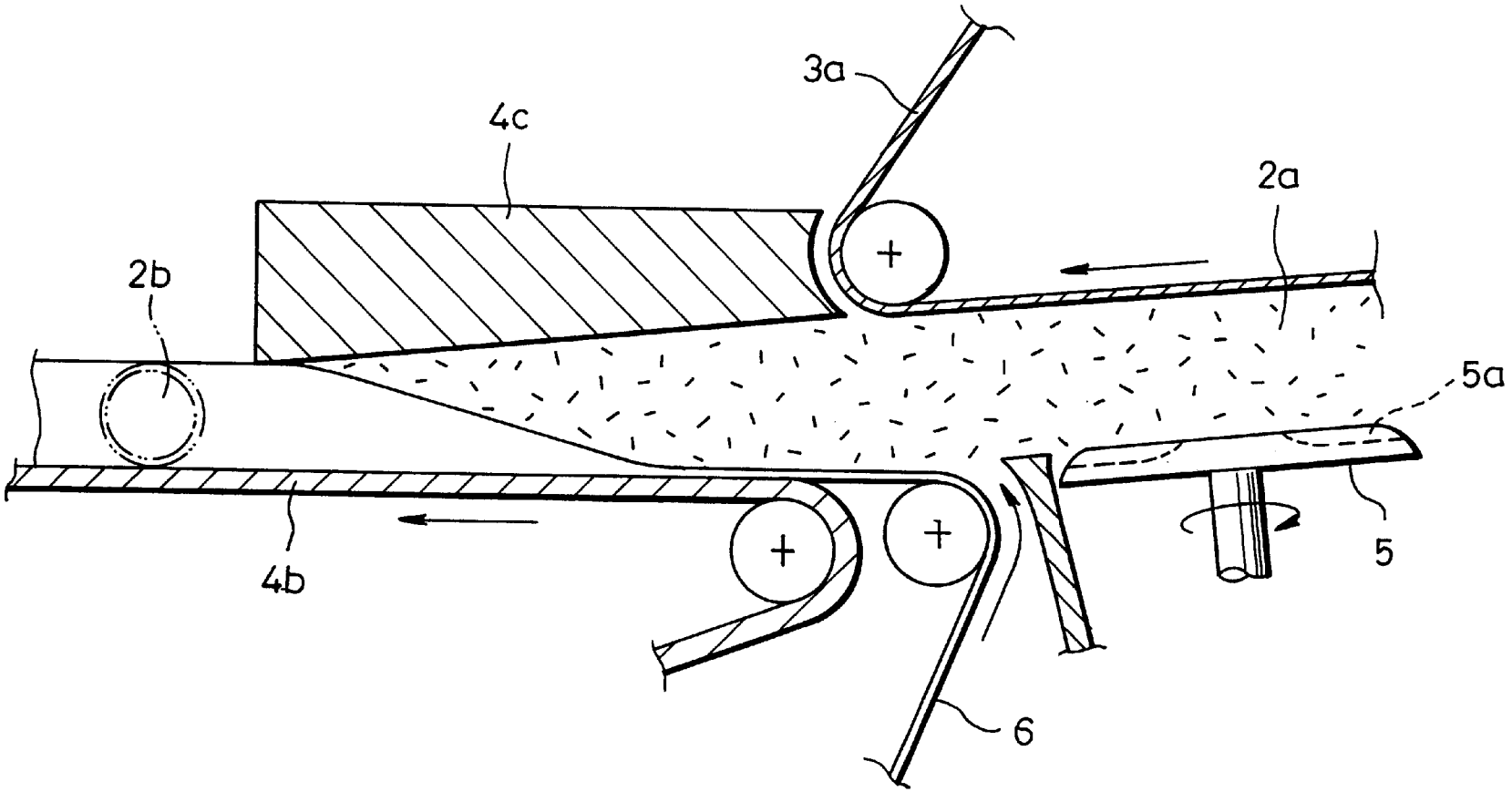
FIG. 2 BACKGROUND ART
FIG. 2 is a view schematically showing the state of tobacco shreds continuously wrapped with a cigarette paper.
Figure 3:
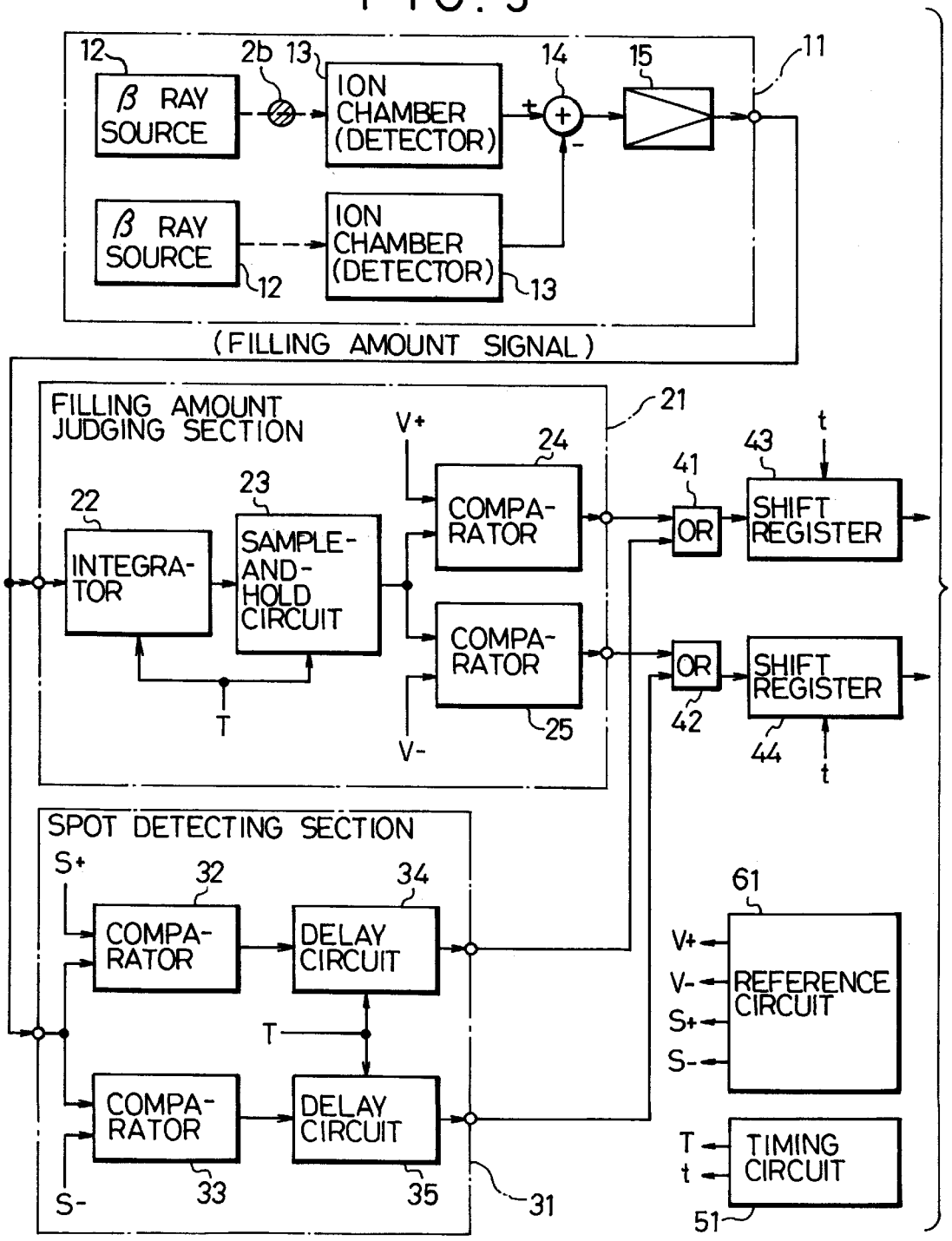
FIG. 3 is a block diagram showing a configuration of a tobacco shreds filling amount monitoring system in a cigarette manufacturing apparatus in accordance with one embodiment of the present invention.

The cigarette manufacturing apparatus in accordance with this embodiment is basically configured as shown in FIGS. 1 and 2, and the filling amount monitoring system for tobacco shreds 2*a* which fulfills the characteristic features of the present invention is schematically configured as shown in FIG. 3.

This filling amount monitoring system has a function of continuously detecting the filling density of tobacco shreds 2*a* at every portion in the lengthwise direction of the tobacco rod 2*b*, monitoring the total filling amount (average filling amount) of tobacco shreds 2*a* per one cigarette in accordance with the filling density, and determining whether the whole filling amount of the cigarette is surplus or short. Further, the filling amount monitoring system has a function of detecting the local excess filling portion (hard spot) and deficient filling portion (soft spot) of tobacco shreds 2*a* at every portion in the lengthwise direction of the tobacco rod 2*b* in accordance with the filling density.

More specifically, as shown in FIG. 3, the filling amount monitoring system has a scanning head (sensor) 11 for continuously detecting the filling density of tobacco shreds 2*a* at every portion in the lengthwise direction of the tobacco rod 2*b* continuously wrapped in the wrapping unit 4. The scanning head 11, which consists mainly of a radiation density detector and is arranged close to the conveying path of tobacco rod 2*b*, continuously detects the filling density of tobacco shreds 2*a* at every portion in the lengthwise direction of the tobacco rod 2*b* passing through the sensing portion.

Specifically, the scanning head has, for example, a pair of β ray sources 12, 12 and two ion chambers receiving the β rays radiated from the β ray source 12, 12. One β ray radiation path is used as the sensing portion through which the tobacco rod 2*b* passes and the other β ray radiation path as a reference system. The tobacco rod 2*b* passing through the sensing portion attenuates the β rays reaching the ion chamber 13 depending on the filling density of tobacco shreds 2*a*. Therefore, by measuring the amount of β rays received by one ion chamber 13, the filling density of tobacco shreds 2*a* is determined from the attenuation amount of β rays. In particular, by determining a difference between the β ray amount attenuated depending on the filling density of tobacco shreds 2*a* and the β ray amount determined by the ion chamber 13 of the reference system by using a subtractor 14, the time-related attenuation of the β ray sources 12, 12 is compensated, and the filling density (filling amount) of tobacco shreds 2*a* in the tobacco rod 2*b* is detected with high accuracy. the information on the filling density (filling amount) of tobacco shreds 2*a* at every portion in the lengthwise direction of the tobacco rod 2*b*, detected continuously in such a manner, is output as an analog filling amount signal via an amplifier 15.

The filling amount judging section plays a role in determining the filling amount of tobacco shreds 2*a* per one cigarette in the tobacco rod 2*b* in accordance with the filling amount signal generated from the scanning head 11, outputting it as a filling amount control signal, and judging whether the filling amount is surplus or short.

Specifically, the filling amount judging section 21 includes an integrator 22, a sample-and-hold circuit 23, and two comparators 24 and 25. The integrator 22, which is reset by a timing signal T generated by a timing circuit 51 in synchronization with the rotation of the main shaft 4*a*, integrates the filling amount signal over one period of timing signal T. By this integration of the filling amount signal, the filling amount of tobacco shreds 2*a* per one cigarette is determined. The sample-and-hold circuit 23, which is operated in accordance with the timing signal T, samples and holds the total filling amount (integral value of filling amount signal) of tobacco shreds 2*a* per one cigarette determined by the integrator 22. The timing signal T consists of a timing pulse signal indicative of the cut position of the tobacco rod 2*b*. For example, the sample-and-hold circuit 23 is driven at the leading edge of the timing signal T, and the integrator 22 is reset at the trailing edge thereof.

The two comparators 24 and 25 compare the integral value (total filling amount of tobacco shreds 2*a* per one cigarette) held by the sample-and-hold circuit 23 with the filling amount threshold values $V_+$ and $V_-$ set in advance in accordance with the target filling amount by a reference circuit 61, respectively, to judge whether the filling amount of tobacco shreds 2*a* per one cigarette is surplus or short. Specifically, when the total filling amount (integral value) of tobacco shreds 2*a* exceeds the reference value (filling amount threshold value $V_+$), the comparator 24 judges that the filling amount is surplus. In synchronization with the cutting of the cigarette portion judged to have an excess filling amount from the tobacco rod 2*b*, the comparator 24 generates a removal signal giving instructions to reject this cigarette. When the total filling amount of tobacco shreds 2*a* is smaller than the reference value (filling amount threshold value $V_-$), the comparator 25 judges that the filling amount is short. In synchronization with the cutting of the cigarette portion judged to have a deficient filling amount from the tobacco rod 2*b*, the comparator 25 generates a removal signal giving instructions to reject this cigarette.

Besides, the filling amount judging section 21 plays a role in determining the average filling amount of tobacco shreds 2*a* in the tobacco rod 2*b* and the standard deviation of the filling amount from the total filling amount per one cigarette detected successively as described above, and controlling the filling amount of tobacco shreds 2*a* (average filling amount control). In accordance with this control information, for example, the control of the suction amount of tobacco shreds 2*a* to the conveyor belt 3*a* in the suction unit 3 (control of negative pressure) and the height adjustment of the trimming disk 5 (control of thickness) are carried out.

On the other hand, a spot detecting section 31 plays a role in detecting the local excess filling portion (hard spot) and local deficient filling portion (soft spot) of tobacco shreds 2*a* at every portion in the lengthwise direction of the tobacco rod 2*b*. This spot detecting section 31 has two comparators 32 and 33 and two delay circuits 34 and 35. The comparators 32 and 33 receive the filling amount signal, and continuously judge the local filling amount (filling density) by comparing the momentary value indicating the filling amount of tobacco shreds 2*a* at every portion in the lengthwise direction of tobacco rod 2*b* with first and second threshold values $S_+$ and $S_-$.

The first threshold value $S_+$ is set to a value 15 to 25% higher than a reference, the reference being, for example, the target filling amount (filling density) at the cut portion where the filling amount of tobacco shreds 2*a* in the tobacco rod 2*b* is partially increased. The second threshold value $S_-$ is set to a value 15 to 25% lower than the target filling amount (filling density) of tobacco shreds 2*a* at the main portion excluding the cut portion of the tobacco rod 2*b*. When the local filling density of tobacco shreds 2*a* at every portion in the lengthwise direction of the tobacco rod 2*b*, which is indicated as the momentary value of the filling amount signal, exceeds the first threshold value $S_+$, the comparator 32 judges that the portion is the excess filling portion (hard spot). When the local filling density of tobacco shreds 2*a*, which is indicated as the momentary value of the filling amount signal, is lower than the second threshold value $S_+$, the comparator 33 judges that the portion is the deficient filling portion (soft spot).

Conventionally, the filling amount of tobacco shreds 2*a* has merely been monitored as a whole as the total filling amount of tobacco shreds 2*a* per one cigarette in the tobacco rod 2*b* or as the filling amount (filling density) of tobacco shreds 2*a* at the dense end portion by the aforementioned filling amount judging section 21. Additionally, in the present invention, the momentary value of the filling amount signal, which varies every moment, is compared continuously with the first and second threshold values $S_+$ and $S_-$ and judgment is made by the two comparators 32 and 33 in the spot detecting section 31, by which the local excess and deficiency of the filling amount (filling density) of tobacco shreds 2*a* at every portion in the lengthwise direction of the tobacco rod 2*b* are detected continuously.

The judgment result of these comparators 32 and 33 is output as a removal signal giving instructions to reject a cigarette, cut from the tobacco rod 2*b*, including the excess filling portion (hard spot) or deficient filling portion (soft spot) of tobacco shreds 2*a*. In particular, the removal signal is timing regulated via the delay circuits 34 and 35, which are driven by receiving the timing signal T, and generated in synchronization with the cutting of a cigarette from the tobacco rod 2*b*.

In the filling amount judging section 21, after the analog filling amount signal is integrated over one cigarette, the total filling amount of tobacco shreds 2*a* is judged from the integral value. Meanwhile, in the spot detecting section 31, the analog filling amount signal is judged in real time. For this reason, a time shift corresponding to one cigarette occurs in the judgment timing. To absorb this time shift, the delay circuits 34 and 35 delays the judgment result (removal signal) of the comparators 32 and 33 for a time corresponding to one cigarette, by which the judgment result of the comparators 32 and 33 is synchronized with the output timing of the judgment result (removal signal) from the filling amount judging section 21.

The outputs (removal signals) from the filling amount judging section 21 and the spot detecting section 31 are input to shift registers 43 and 44 for removal control through OR circuits 41 and 42. The removal signals are further timing regulated by the shift registers 43 and 44, and given to the removal control section (not shown) of a filter attachment unit 8. As a result, the cigarette rod 2*c* including the excess filling portion (hard spot) or deficient filling portion (soft spot) is cut from the tobacco rod 2*b* in the cutting section 7, and the removal signal is given to the removal control section (not shown) of the filer attachment unit 8 in synchronization with the timing at which the cigarette rod 2*c* is sent to the filter attachment unit 8.

Figure 4:
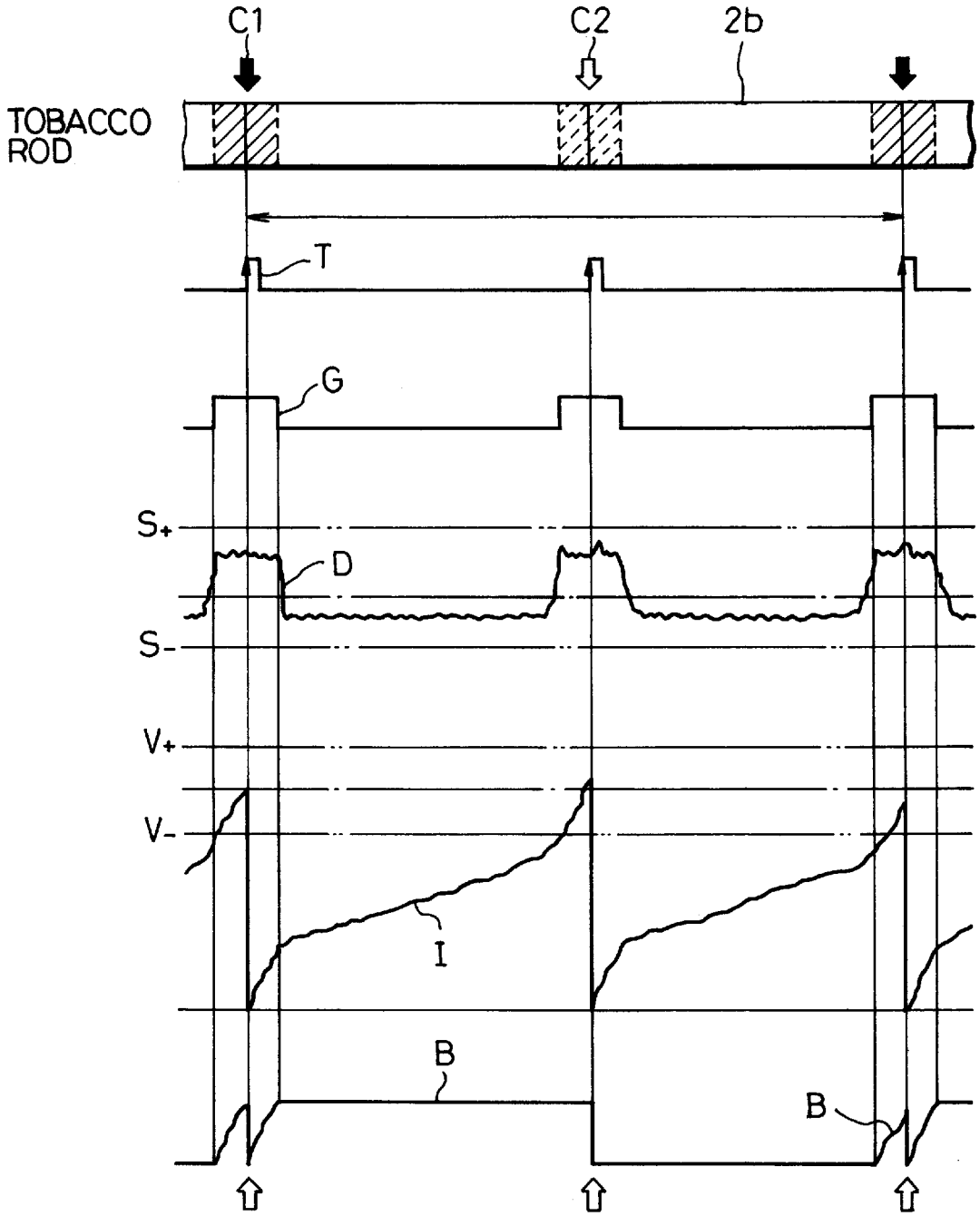
FIG. 4 is a diagram schematically showing the relationship between the tobacco rod state, the cut timing signal, the signal mode at each position such as an analog filling amount signal, and the sampling timing for these signals, for illustrating one embodiment of the present invention.

FIG. 4 schematically shows the relationship between the state of tobacco rod 2*b* continuously wrapped in the wrapping unit, the cut positions of the tobacco rod 2*b*, the cut timing signal giving instructions to cut the tobacco rod 2*b*, the filling amount signal determined continuously from the tobacco rod 2*b*, the signal mode at each position determined from the filling amount signal, and the timing for these signals.

The functions and operation of the spot detecting section 31 will now be described in more detail with reference to FIG. 4. In the wrapping unit 4, one tobacco rod 2*b* wrapped into a long rod has portions where the filling amount of tobacco shreds 2*a* is partially increased at intervals of one cigarette by the action of the pocket 5*a* of the trimming disk 5 rotated in synchronization with the timing signal T. The portion where the filling amount of tobacco shreds 2*a* is partially increased is the cut portion of tobacco rod 2*b* as indicated by hatching.

The timing signal T is generated at each predetermined timing by counting a reference clock generated by an encoder (not shown) connected to the main shaft 4*a*. Assuming that for example, when the main shaft 4*a* makes one turn, the encoder generates a reference clock of 1200 pulses corresponding to the length of four cigarette rods 2*c*, the timing signal T is generated as a signal for defining the first cut timing at the time when 81 pulses of reference clock are counted from the reference position (0 pulse position), and subsequently, it is generated each time 150 pulses of the reference clock are counted. Therefore, the timing signal T is generated with a period corresponding to the length of one cigarette.

The trimmer disk 5 is rotated in synchronization with the timing signal T, and the pocket 5*a* thereof is positioned at a portion facing the lower surface of the conveyor belt for a time period of 20 pulses before and after the timing signal T (a total of 40 pulses) as indicated as a gate signal G. By the rotation control of the trimmer disk 5, the filling amount of tobacco shreds 2*a* in the lengthwise direction of the tobacco rod 2*b* is partially increased with a period of the length of one cigarette.

The tobacco rod 2*b* is cut to a unit of the cigarette rod 2*c* corresponding to the length of two cigarettes in accordance with the timing signal T in the cutting section 7, and then the cigarette rods 2*c* are sequentially supplied to the filter attachment unit 8, where they are cut to a length of one cigarette. The cutting of the tobacco rod 2*b* in the cutting section 7 is done in synchronization with the odd-numbered timing (black arrow C1) of the timing signal T (control of tobacco rod cut position). The even-numbered timing (white arrow C2) of the timing signal T is used as a timing for regulating the position where the cigarette rod 2*c* is cut in half when a filter chip is mounted to the cigarette rod 2*c* in the filter attachment unit 8 (control of final cut position).

On the other hand, the tobacco shreds 2*b* wrapped continuously are introduced to the scanning head 11 in connection with the wrapping, and the filling amount of every portion in the lengthwise direction is continuously inspected. The scanning head 11 continuously detects the filling amount (filling density) of tobacco shreds 2*a* at every portion in the lengthwise direction of the tobacco rod 2*b* as shown as an analog filling amount signal D in FIG. 4.

The aforementioned filling amount judging section 21 integrates the thus detected analog filling amount signal D over the period corresponding to one cigarette in accordance with the timing signal T, for example, as shown as an integration output signal I in FIG. 4, and thereby determines the total filling amount of tobacco shreds 2*a* filling per one cigarette. The sample held integral value I in the sample-and-hold circuit 23, that is, the total filling amount of tobacco shreds 2*a* per one cigarette is compared with the filling amount threshold values $V_+$ and $V_-$, which have been set in advance, at a timing defined by the timing signal T as shown in FIG. 4. This comparison of the integral value I with the filling amount threshold values $V_+$ and $V_-$ determines whether the filling amount per one cigarette is larger than the target filling amount and whether it is smaller than the target filling amount. In other words, it determines whether the cigarette is an excessively filled cigarette and whether the cigarette is a deficiently filled cigarette.

The average filling amount of tobacco shred 2*a* filling per one cigarette is calculated by averaging the total filling amounts I sequentially determined for each cigarette over a plurality of periods. The standard deviation of filling amount is calculated by determining the distribution of the filling amounts I.

Although the processing circuit is not especially shown herein, the filling amount judging section 21 partially integrates the filling amount signal D at the cut portion, as shown as a partial integration signal B in FIG. 4, for example, in accordance with the timing signal T shown in FIG. 4 and the gate signal G showing the cut portion. This partial integration of the filling amount signal D determines the filling amount (filling density) of tobacco shreds 2*a* at the dense end of the cigarette where the filling amount of tobacco shreds 2*a* is partially increased. By judging the filling amount (partial integral value B) at each timing defined by the timing signal T, the possibility for the tobacco shreds 2*a* to come off from the cut end of the cigarette is judged.

In contrast, the spot detecting section 31 continuously compares the filling density itself of tobacco shreds 2*a* at every portion in the lengthwise direction of tobacco rod 2*b* shown by the filling amount signal D with the first and second threshold values $S_+$ and $S_-$ as shown in FIG. 4. In this case, continuous comparison of the filling amount signal D with the first and second threshold values $S_+$ and $S_-$ is made regardless of the timing signal T. When the magnitude (momentary value) of the filling amount signal D exceeds the first threshold value $S_+$ or falls below the second threshold value $S_-$, it is judged that the filling amount (filling density) of tobacco shreds 2*a* at the detection portion of the filling amount of tobacco rod 2*b* shown by the detection timing is locally surplus or locally short. That is, it is judged that the detection portion is an excess filling portion (hard spot) or a deficient filling portion (soft spot), which poses a quality problem.

Thus, according to the apparatus configured as described above, in the process in which the tobacco rod 2*b* is manufactured by continuously wrapping the tobacco shreds 2*a*, not only whether or not the total filling amount of tobacco shreds 2*a* per one cigarette is proper is sequentially judged but also whether or not a local excess filling portion (hard spot) and/or deficient filling portion (soft spot) is present in the cigarette can be inspected efficiently.

As the wrapping speed increases, the filling density of tobacco shreds 2*a* in the lengthwise direction of tobacco rod 2*b* is liable to be nonuniform, which causes a local excess filling portion (hard spot) and deficient filling portion (soft spot) of tobacco shreds 2*a*. This apparatus can detect these defective portions surely and in real time in connection with the manufacture (wrapping). Also, the excess filling portion (hard spot) and deficient filling portion (soft spot) can be detected easily by using the output of the scanning head 11 used for inspecting the filling amount of tobacco rod 2*b*, that is, the analog filling amount signal D. Further, the detection result (removal signal) of the excess filling portion (hard spot) and deficient filling portion (soft spot) is output in synchronization with the judgment signal (removal signal) for the total filling amount, so that defective cigarettes can be rejected easily and surely in the subsequent filter attachment unit 8 etc.

Figure 5:
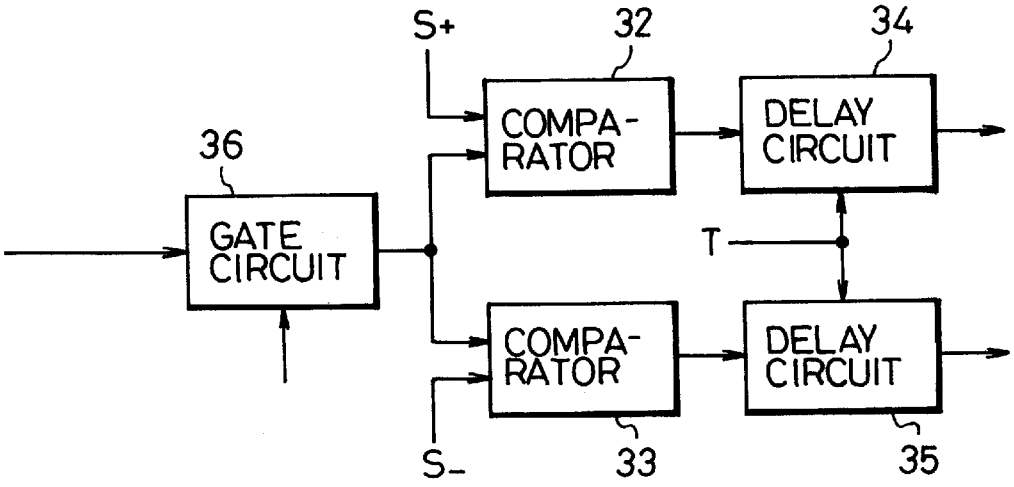
FIG. 5 is a block diagram showing another example of a configuration of a spot detecting section showing another embodiment of the present invention.

In the above-described embodiment, the first and second threshold values $S_+$ and $S_-$ are set fixedly, and the local filling amount of tobacco rod 2*b* is judged uniformly in the lengthwise direction. However, for example, as shown in FIG. 5, a gate circuit 36 may be provided at the front stage of the comparators 32 and 33 in the spot detecting section 31 to judge only the local excess and deficiency of the filling amount at the cut portion where the filling amount of tobacco shreds 2*a* is increased in the tobacco rod 2*b*. In this case, the first and second threshold values $S_{+1}$ and $S_{-1}$ may be set to be 15 to 25% higher and lower than the reference, respectively, the reference being the target filling amount of tobacco shreds 2*a* at the cut portion. When the filling amount exceeds the first threshold value $S_{+1}$, which is set to be 15 to 25% higher than the target filling amount, the detected portion may be judged to be an excess filling portion (hard spot), and when the filling amount falls below the second threshold value $S_{-1}$, which is set to be 15 to 25% lower than the target filling amount, that portion may be judged to be a deficient filling portion (soft spot).

Likewise, only the filling amount signal at the main portion excluding the cut portion where the filling amount of tobacco shreds 2*a* is increased is extracted via the gate circuit 31, and the filling amount at that portion is compared with the first and second threshold values $S_{+2}$ 2 and $S_{-2}$, which are 15 to 25% higher and lower than the target filling amount of tobacco shreds 2*a* at that portion, respectively, by which an excess filling portion (hard spot) and deficient filling portion (soft spot) at the main portion may be detected.

Figure 6:
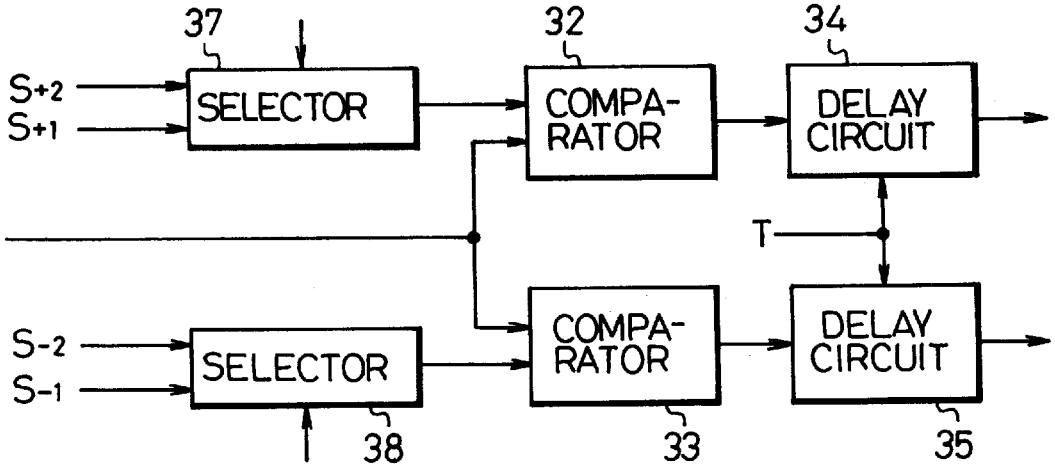
FIG. 6 is a block diagram showing still another example of a configuration of a spot detecting section showing another embodiment of the present invention.
Figure 7:
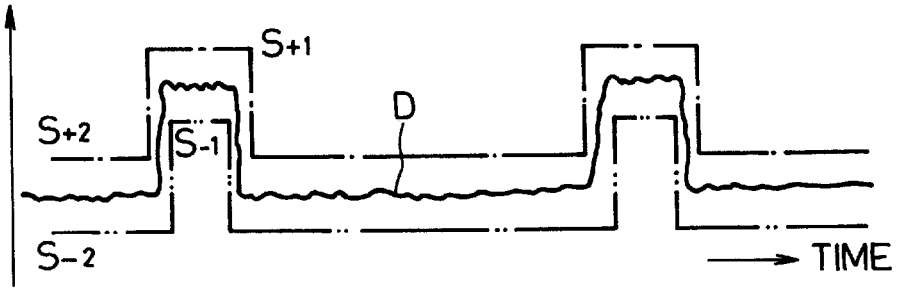
FIG. 7 is a diagram showing the relationship between the first and second threshold values $S_+$ and $S_-$ set in the spot detecting section shown in FIG. 6 and the analog filling amount signal.

Further, in order to separately detect an excess filling portion (hard spot) and deficient filling portion (soft spot) at the main portion of tobacco rod 2*b* and the cut portion where the filling amount of tobacco shreds 2*a* is increased, for example, as shown in FIG. 6, selectors 37 and 38 for selectively setting the first and second threshold values $S_{+1}$, $S_{+2}$, $S_-$, and $S_{-2}$ is provided, by which comparison reference threshold values $S_+$ and $S_-$ given to the comparator 32 and 33 may be variably set in accordance with the general level change of the filling amount signal D as shown in FIG. 7. In this case, for example, the first and second threshold values $S_+$ and $S_-$, which are set in advance, may be changed by a level $\alpha$ corresponding to the increased amount of tobacco shreds 2*a* at the cut portion of tobacco rod 2*b*. Specifically, the apparatus can be so configured that the level a is added to or subtracted from the first and second threshold values $S_+$ and $S_-$ by using an adder (not shown) in place of the selectors 37 and 38.

According to the configuration in which the threshold values $S_+$ and $S_-$ for detecting the excess filling portion (hard spot) and deficient filling portion (soft spot) are variably set in accordance with the change in filling amount of the tobacco rod 2*b* such that the filling amount of tobacco shreds 2*a* is increased at the cut portion, the excess filling portion (hard spot) and deficient filling portion (soft spot) with respect to the target filling amount of tobacco shreds 2*a* at every portion in the lengthwise direction of the tobacco rod 2*b* can be detected. By rejecting the cigarette having these defective portions, the cigarette production quality can be enhanced.

The present invention is not limited to the above-described embodiment. For example, the present invention can be applied similarly to the apparatus using infrared rays or ultrasonic waves instead of β rays as the scanning head 11. Also, as the delay circuits 34 and 35 for timing adjustment, shift registers driven by receiving, for example, the timing signal T may be used. Needless to say, in addition to the sensors for detecting the filling amount of one cigarette, special purpose sensors for detecting an excess filling portion (hard spot) and deficient filling portion (soft spot) may be provided. In addition, the present invention can be carried out by making various modifications without departing from the spirit and scope of the present invention.

INDUSTRIAL APPLICABILITY

As described above, according to the present invention, a local excess filling portion or deficient filling portion at every portion in the lengthwise direction of the tobacco rod is detected by comparing the momentary value of the filling amount signal indicative of the filling amount (filling density) of tobacco shreds at every portion in the lengthwise direction of the tobacco rod with the threshold values set in advance, and the detection result is output in synchronization with the conveying timing of the cigarette rod of a predetermined length cut from the tobacco rod or the cigarette. Therefore, in addition to the removal of a cigarette in which the total filling amount is short, which has been effected conventionally, the cigarette including a local excess filling portion (hard spot) and/or deficient filling portion (soft spot) of tobacco shreds can be rejected surely. As a result, the production quality can be enhanced even if the cigarette manufacturing speed is increased.

Moreover, since the aforesaid excess filling portion or deficient filling portion is detected under the threshold values set in accordance with the filling amount of each portion in which the filling portion is controlled, a local excess filling portion (hard spot) and local deficient filling portion (soft spot), which pose a quality problem, can be detected easily and surely. Therefore, an effect can be achieved that defective cigarettes can be rejected based on the inspection result of the total filling amount of cigarette, and also a cigarette including the defective portions can be rejected surely.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A cigarette manufacturing apparatus for continuously manufacturing cigarettes by continuously wrapping tobacco shreds, continuously supplied while the supply amount thereof is controlled, with an elongated cigarette paper to form a tobacco rod and cutting said tobacco rod to predetermined lengths, said cigarette manufacturing apparatus comprising:

measuring means for continuously measuring the filling amount of tobacco shreds at every portion in the lengthwise direction of said tobacco rod in connection with the continuous wrapping operation of said tobacco rod, said measuring means including a radioactive radiation density sensor;

detecting means for detecting at least one of a local excess filling portion and a deficient filling portion of said tobacco rod at every portion in the lengthwise direction of said tobacco rod by comparing the filling amount at every portion in the lengthwise direction of said tobacco rod determined by said measuring means with an allowable upper threshold value, set in advance, above which the local excess filling portion is observed and with an allowable lower threshold value, set in advance, below which the local deficient filling portion is observed; and means for outputting the detection result in synchronization with the conveying timing of a cigarette containing said local excess filling portion or deficient filling portion of said tobacco shreds among the cigarettes of a predetermined length cut sequentially from said tobacco rod, as a signal for giving instructions to means for rejecting the cigarette to reject the cigarette containing said local excess filling portion or deficient filling portion.

2. The cigarette manufacturing apparatus according to claim 1, wherein said cigarette manufacturing apparatus further comprises:

filling amount detecting means for determining the total filling amount of tobacco shreds per one cigarette cut from said tobacco rod by integrating the filling amount at every portion in the lengthwise direction of said tobacco shreds determined by said measuring means;

Means for controlling the supply amount of tobacco shreds supplied for the wrapping operation in accordance with said total filling amount of tobacco shreds; and means for detecting a cigarette portion where the filling amount of tobacco shreds in said tobacco rod is short by judging said total filling amount of tobacco shreds.

3. The cigarette manufacturing apparatus according to claim 1 or 2, wherein the control of the supply amount of said tobacco shreds is carried out so that the filling amount of tobacco shreds at the cut portion of the tobacco rod continuously wrapped with said cigarette paper is larger than the filling amount of tobacco shreds at portions other than said cut portion, the detection of at least one of a local excess filling portion and deficient filling portion of tobacco shreds in the tobacco rod is carried out by comparing the filling amount of said tobacco shreds at every portion in the lengthwise direction of said tobacco rod, which is detected continuously, with a first threshold value set to be higher than the target filling density of said tobacco shreds at said cut portion and a second threshold value set to be lower than the target filling density of said tobacco shreds at portions other than said cut portion, and when a filling density higher than said first threshold value is detected, the portion of said tobacco rod where that filling density is determined is detected as an excess filing portion, and when a filling density lower than said second threshold value is detected, the portion of said tobacco rod where that filling density is determined is detected as a deficient filling portion.

4. The cigarette manufacturing apparatus according to claim 1, wherein said detecting means includes:

a first comparator for receiving a filling amount signal from said measuring means;

a second comparator for receiving the filling amount signal from the measuring means; and the first comparator compares the filling amount signal with said upper threshold value at every portion in the lengthwise direction of the tobacco rod and the second comparator compares the filling amount signal with said lower threshold value at every portion in the lengthwise direction of the tobacco rod.

5. The cigarette manufacturing apparatus according to claim 4, wherein when the first or second comparators determine that the filling amount at any moment exceeds or is lower than said upper and lower threshold values, respectively, a signal is output to reject the cigarette.

* * * * *